166-274

1/18/83

SR

XR 4,368,781

United States Patent [19]

Anderson

[11] 4,368,781

[45] Jan. 18, 1983

[54] METHOD OF RECOVERING VISCOUS PETROLEUM EMPLOYING HEATED SUBSURFACE PERFORATED CASING CONTAINING A MOVABLE DIVERTER

[75] Inventor: Donald J. Anderson, Newport Beach, Calif.

[73] Assignee: Chevron Research Company, San Francisco, Calif.

[21] Appl. No.: 198,514

[22] Filed: Oct. 20, 1980

[51] Int. Cl.[3] ..... E21B 36/00; E21B 43/12; E21B 43/24

[52] U.S. Cl. ..... 166/252; 166/50; 166/272; 166/274; 166/306

[58] Field of Search ..... 166/252, 251, 250, 272, 166/274, 303, 306, 50, 64, 77, 187

[56] References Cited

U.S. PATENT DOCUMENTS

| | | | |
|---|---|---|---|
| 1,816,260 | 7/1931 | Lee | 166/50 X |
| 2,828,823 | 4/1958 | Mounce | 166/187 |
| 3,126,961 | 3/1964 | Craig, Jr. et al. | 166/303 |
| 3,312,284 | 4/1967 | D'Audiffret et al. | 166/50 X |
| 3,386,508 | 6/1968 | Bielstein et al. | 166/272 |
| 3,913,671 | 10/1975 | Redford et al. | 166/272 X |
| 3,960,213 | 6/1976 | Striegler et al. | 166/50 X |
| 3,994,340 | 10/1976 | Anderson et al. | 166/272 |
| 3,994,341 | 10/1976 | Anderson et al. | 166/272 |
| 4,037,658 | 7/1977 | Anderson | 166/272 |
| 4,099,570 | 7/1978 | Vandergrift | 166/50 X |
| 4,116,275 | 9/1978 | Butler et al. | 166/50 X |
| 4,194,577 | 3/1980 | Vann | 166/50 X |
| 4,248,302 | 2/1981 | Churchman | 166/50 X |

*Primary Examiner*—Stephen J. Novosad

*Attorney, Agent, or Firm*—G. W. Wasson; Edward J. Keeling

[57] ABSTRACT

A method is disclosed for recovering viscous petroleum from subsurface formation, such as tar sands, wherein a substantially horizontal, perforated casing is positioned in the formation and a movable diverter is positioned to direct a hot drive fluid out through the perforations and into the formation to move the viscous petroleum that has been heated by the drive fluid toward a production location. The production is monitored for content of drive fluid and petroleum and the position of the diverter is controlled in accordance with the monitored production to optimize the production of petroleum and to maintain the communication path within the formation between the injection location and the production location.

9 Claims, 4 Drawing Figures

METHOD OF RECOVERING VISCOUS PETROLEUM EMPLOYING HEATED SUBSURFACE PERFORATED CASING CONTAINING A MOVABLE DIVERTER

BACKGROUND OF THE INVENTION

This invention relates to recovering viscous petroleum from petroleum-containing formations. Throughout the world there are several major deposits of high-viscosity crude petroleum in oil sands not recoverable in their natural state through a well by ordinary production methods. In the United States, the major concentration of such deposits is in Utah and California. By far the largest deposits in the world are in the Province of Alberta, Canada. The depths of these deposits range from surface outcroppings to about 2000 feet.

To date, none of these deposits has been produced commercially by an in-situ technology. Two commercial mining operations exist, and they are in a shallow Athabasca deposit and others are proposed. There have been many in-situ well-to-well pilots, all of which used some form of thermal recovery after establishing communication between an injector well and a producer well. Normally such communication has been established by introducing a pancake fracture. The displacing or drive mechanism has been steam and combustion or steam and chemicals. Another proposal is to develop well-to-well communication by injecting steam over a period of several years into a high water saturation zone underlying the tar sand deposit at a depth of round 1800 feet. Probably the most active in-situ pilot in the oil sands uses the huff-and-puff single-well method of steam stimulation. This pilot has been producing about 5000 barrels of viscous petroleum per day for several years from about 50 wells.

The most difficult problem in any in-situ well-to-well viscous petroleum project is establishing and maintaining communication between injector and producer. In shallow deposits, fracturing to the surface has occurred in a number of pilots whereupon satisfactory drive pressure could not be maintained. In many cases, problems arise from healing of the fracture when the viscous petroleum that had been mobilized through heat cooled as it moved toward the producer. The cool petroleum is essentially immobile, since its viscosity in the Athabasca deposits, for example, is on the order of 100,000 to 1,000,000 cp at reservoir temperature.

As noted, the major problem of the economic recovery from many formations has been establishing and maintaining communication between an injection position and a recovery position in the viscous oil-containing formation. This is primarily due to the character of the formations, where effective mobility of fluids may be extremely low, and in some cases, such as the Athabasca Tar Sands, virtually nil. Thus, the Athabasca Tar Sands, for example, are strip mined where the overburden is limited. In some tar sands, hydraulical fracturing has been used to establish communication between injectors and producers. This has not met with uniform success. A particularly difficult situation develops in the intermediate overburden depths, which cannot stand fracturing pressure.

Heretofore, many processes have been utilized in attempting to recover viscous petroleum from viscous oil formations of the Athabasca Tar Sands type. The application of heat to such viscous petroleum formations by steam or underground combustion has been attempted. The use of vertical slotted liners positioned in the viscous oil formation as a conduit for hot fluids has also been suggested. However, these methods have not been overly successful because of the difficulty of establishing and maintaining communication between the injector and the producer. Clearly, if one could establish and maintain communication between injector and producer, regardless of the drive fluid or recovery technique employed, it would open up many of these viscous petroleum deposits to a number of potentially successful projects.

BRIEF DESCRIPTION OF THE INVENTION

The present invention is directed to a method of assisting the recovery of viscous petroleum from a petroleum-containing formation and is particularly useful in those formations where communication between an injector and a producer is difficult to establish and maintain. A hole is formed through the petroleum-containing formation and a generally horizontal, hollow tubular member is inserted into the hole to provide a continuous, uninterrupted flow path through the formation. A hot fluid is flowed through the interior of the tubular member to heat viscous petroleum in the formation outside the tubular member to reduce the viscosity of at least a portion of the petroleum adjacent the outside of the tubular member to provide a potential passage for fluid flow through the formation adjacent the outside of the tubular member. The tubular member may initially be perforated in the zone where recovery of the viscous petroleum is desired or the tubular member may be subsequently perforated to provide passage ways into the formation for the hot fluids passing within the tubular member. An initial breakthrough between the formation and the producer well establishes flow of the heated viscous petroleum and the hot fluid into the producer well. A diverter, for example, a settable, inflatable packer, is placed within the tubular member to cause the hot fluid to pass out through the perforations into the formation—there acting as a drive fluid to force the heated petroleum toward the producer well. In most cases the initial placement of the packer will be close to the producing well in order to maximize the pressure gradient between drive fluid and producing well, thereby facilitating early communication and petroleum production. The ratio of produced petroleum to drive fluid is monitored in the producer well to recognize an indication of excessive pass-through of the drive fluid and, based on the observed ratio, the diverter is moved within the tubular member to optimize the petroleum economic production rate and minimize the drive fluid pass-through.

The diverter may be moved back and forth within the casing between the end near the production well and the end near the injection well to maximize both the heating of the formation and the movement of the heated viscous petroleum into the producer well. In the event of an unwanted breakthrough of the drive fluid the diverter can be moved to another location within the casing so as to maintain a desired formation heating and petroleum movement as the breakthrough heals.

In the preferred form, the hot fluid which is flowed through the tubular member is steam, and the drive fluid used to promote movement of the petroleum is also steam. Under other conditions, the hot fluid and the drive fluid may be injected intermittently. The injectivity of the drive fluid into the formation is controlled to some extent by adjusting the condition of the hot fluid flowing through the tubular member. In this manner, the sweep efficiency of the drive fluid in the formation may be improved.

In one form, the present invention deals with the recovery of viscous petroleum from a tar sand formation of an Athabasca type. An injection shaft and a recovery shaft are formed and extend from the earth's surface through the tar sand formation. A hole is formed through the tar sand formation between the injection shaft and the recovery shaft, and a solid-wall, hollow tubular member is inserted into the hole to provide a flow path from the injection shaft to the recovery shaft through the tar sand formation. A hot fluid, preferably steam, is flowed through the interior of the tubular member to heat the viscous petroleum in the tar sand formation between the injection shaft and the recovery shaft outside the tubular member thus reducing the viscosity of at least a portion of the viscous petroleum adjacent the outside of the tubular member to provide a potential passage for fluid flow through the tar sand formation adjacent the outside of the tubular member. A drive fluid is injected into the formation through perforations in the tubular member to promote flow of petroleum toward the recovery shaft and the petroleum is recovered from the recovery shaft. As noted, the preferred hot fluid is steam, although other fluids may be used. Steam also is preferred for use as a drive fluid. In some situations, other fluids such as gas, water or solvents may be useful drive fluids, either alone or in combination with steam.

OBJECT OF THE INVENTION

The principal object of the present invention is to optimize the recovery of viscous petroleum from a petroleum-containing formation wherein communication between an injector position and producer position is difficult to establish and, when once established, is difficult to maintain as a path for produced petroleum.

A further object of the present invention is a method for moving the position of injection of a drive fluid in the communication path between an injector position and a producer position in a viscous petroleum-containing formation to both optimize the production of petroleum and to maintain the communication path.

Further objects and advantages of the present invention will become apparent when the description is read in view of the accompanying drawings which are made a part of this specification.

DETAILED DESCRIPTION OF THE EMBODIMENTS OF THE INVENTION

Figure 1:
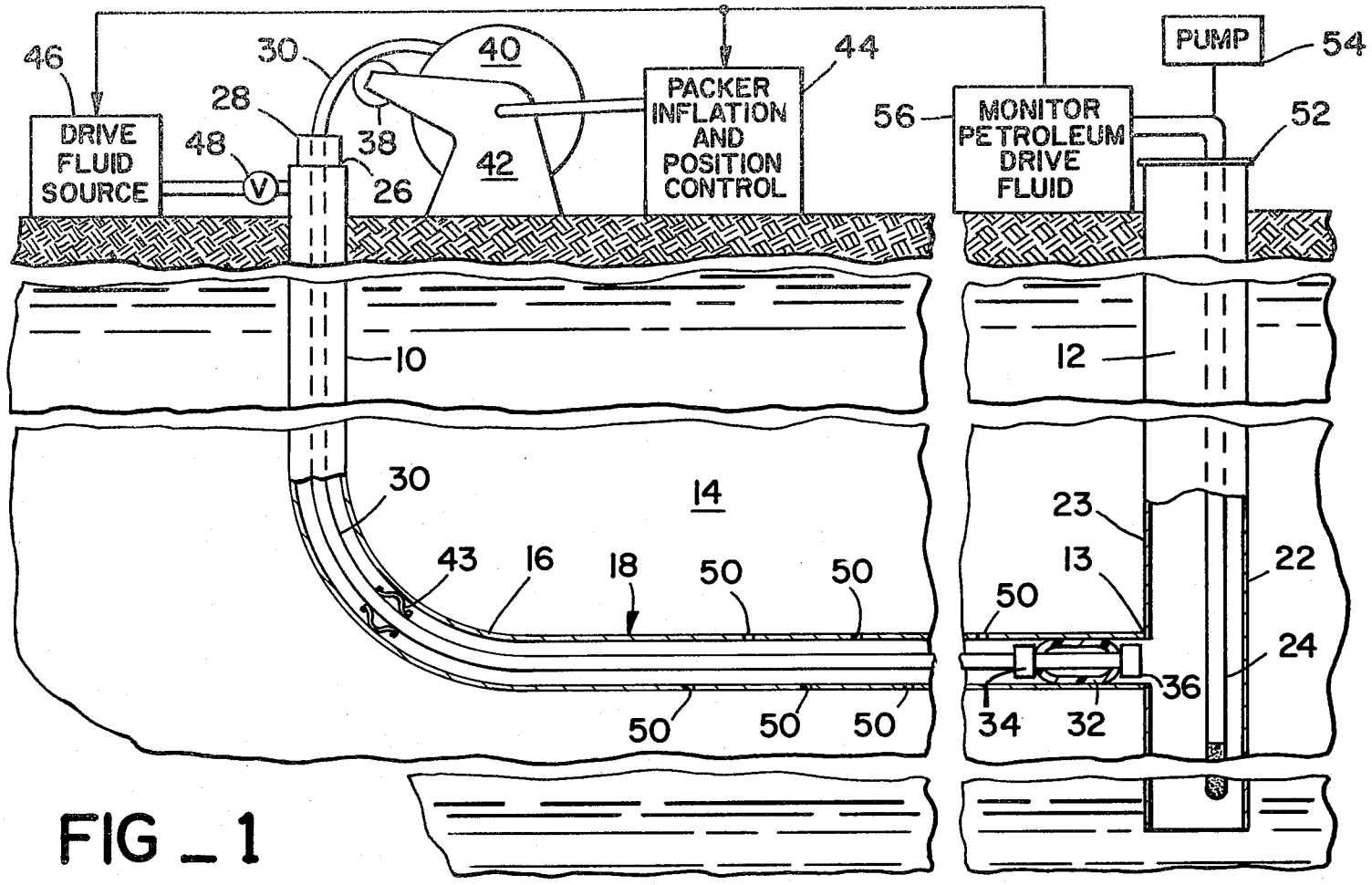
FIG. 1 is an elevation view partially in section illustrating one form of apparatus assembled in accordance with the present invention for use in recovering viscous petroleum from an underground formation.

Referring now to the drawings, and to FIG. 1 in particular, where the preferred embodiment of apparatus assembled in accordance with the invention is illustrated, FIG. 1 shows a pair of spaced-apart wells or shafts, indicated generally by the numerals 10 and 12, which penetrate the earth to a viscous petroleum or tar sand formation 14. For ease in description, well 10 will be termed an injector shaft 10 and well 12 will be termed a producer shaft 12. As here illustrated, injector shaft 10 may be a continuous well connecting with producer shaft 12 at 13. A solid-wall, hollow tubular member or casing 16 is inserted through at least the generally horizontal portion 18 of the well 10. The tubular member 16 is preferably steel and may be made up of one piece or many connecting joints as a tubing string. The outside of the tubular member 16 contacts the tar sand formation 14 in the horizontal portion 18 and eventually enters the producer shaft 12. The producer well 12 is provided with a casing 22 with perforations at 23, and enclosed therein in a producing string 24 for carrying liquids to the surface above the subsurface formation.

It is not necessary that the injector well connect with the producer well, it is only necessary that the injector be in the near vicinity of the producer well. Near vicinity can mean as far as about ten feet from the producer well. The end of the horizontal portion 18 of the producer should be close enough to accomplish the development of a communication path for heated viscous petroleum from the formation into the producer well 12 through perforations 23 in casing 22.

The generally horizontal portion 18 may vary many degrees from horizontal. It is desirable to have the casing in an alignment that will maximize the heating and driving effect of fluids passing through the casing and for that reason the casing should be generally horizontal.

The injector well 10 is provided with a well head 26 at the earth's surface including a packing gland 28 through which a hollow member 30 passes for entry into the well. Within the well 10 at the horizontal portion 18, a diverter, here shown as an inflatable packer 32, is secured between shoulders 34 and 36. At the surface, the hollow member passes over a pulley 38 and onto a reel 40 on hoist mechanism 42. Spacing means 43 are provided as needed to align the hollow member 30 within the casing 16. A packer inflation and position control 44 provides control for the positioning of the packer 32 within the tubular member 18 and provides surface control for the inflation and deflation of the packer.

The well head 26 also provides an entry path for a drive fluid into the well 10 from drive fluid source 46 through valve 48.

The horizontal portion 18 of the hollow tubular member 16 may be initially perforated at 50 or may be perforated after being positioned in the subsurface formation and after functioning as a hollow passage way between the injector well 10 and the producer well 12.

The surface end of the producer well 12 is provided with a well head at 52 through which a pump mechanism 54 may operate to lift liquids from the subsurface to the surface. The lifted liquids pass into a monitor mechanism 56 where the ratio of produced petroleum to produced drive fluid is determined. The monitor 56 includes means for controlling the packer inflation and position control 44 and the drive fluid source 46 to accomplish a desired positioning of the packer 32 within the member 18 and a desired temperature and pressure of the drive fluid. The mechanism by which these desired controls is accomplished is not essential to the present invention.

Figure 2:
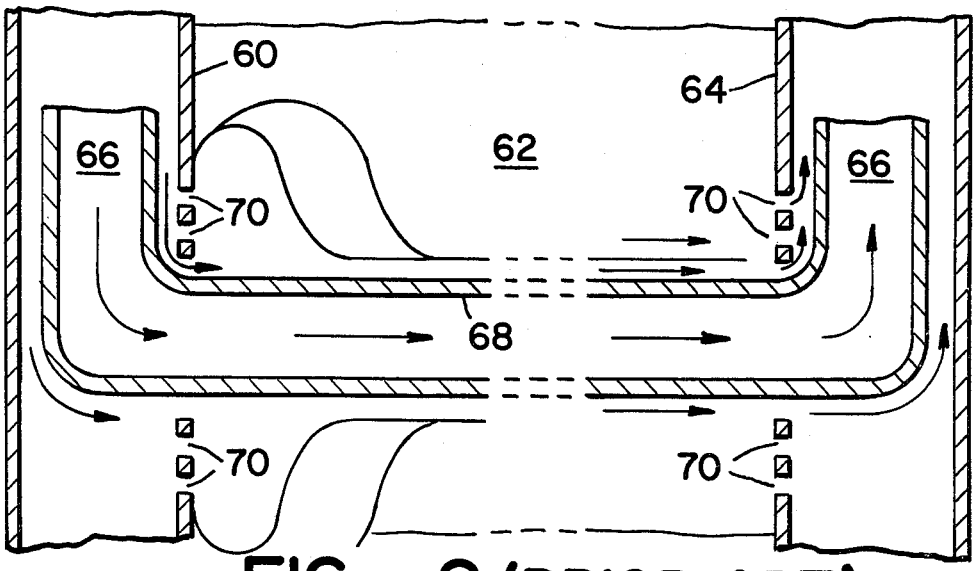
FIG 2 (PRIOR ART)
FIG. 2 is a sectional view representing a prior art method of recovering viscous petroleum from an underground formation.

FIG. 2 illustrates a prior art form of producing viscous petroleum employing an injector well to producer well connection scheme. As here illustrated, a cased injection well 60 penetrates vertically through an earth formation of a viscous petroleum or tar sand formation 62. A cased production well 64 is positioned generally parallel to and spaced from the injection well 60. A tubular member 66 is passed down through the interior of the injection well 60, out through the casing into the formation 62, then through the formation 62 to the cased production well 64, through the casing of the production well 64 and up to the earth's surface through the interior of the production well. As shown in FIG. 2 the horizontal portion 68 of the tubular member is ideally shown as horizontal through the formation 62 and in contact with the formation at its exterior. The injection well and production well are perforated at 70 while the tubular member 66 has a solid exterior along its length.

Steam, or another hot fluid, is pumped through the tubular member 66 to heat the formation surrounding the horizontal portion 68.

Another hot fluid, or steam, is pumped through injection well 60, out through perforations 70 and into the formation 62 to function as a drive fluid for moving heated viscous petroleum through the formation 62 into the production well 64 at perforations 70 therein. Lines 72 and 74 are illustrative of isothermal profiles that might be produced as the drive fluid is pumped into the formation heated by the hot fluid passing through the horizontal portion 68 of tubular member 66.

A problem occurs with the prior art scheme when the drive fluid finds a relatively low resistance path through the formation from the injection well to the production well or out into a permeable path through the formation. Such a condition can exist when the viscous petroleum immediately adjacent to the tubular member 68 becomes mobile enough to be pushed into the production well or pushed at least laterally far enough away from the tubular member 68 to establish a finger breakthrough for the drive fluid. Once that condition has occurred, it is difficult to reestablish a continuously moving heated viscous petroleum to maintain the desired production.

The prior art scheme also has a problem of maintaining an established flow path for the drive fluid through the formation heated by the fluid in the tubular member. It is possible that the drive fluid may find a low resistance path into or through the formation in a path that does not move the heated viscous petroleum toward the production well. With only a single source for the drive fluid there is little likelihood that the loss of drive fluid into the formation can be controlled.

Figure 3:
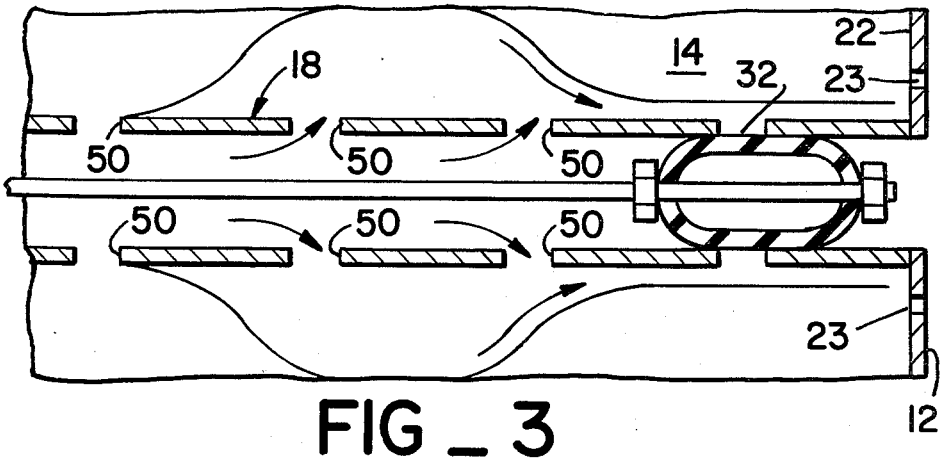
FIG. 3 is a sectional view representing an injection profile expected with the initial position of a diverter in accordance with the method of the present invention.
Figure 4:
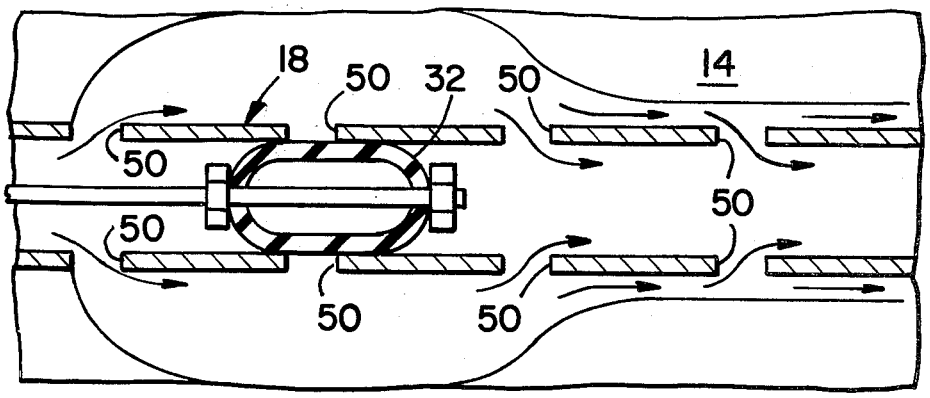
FIG. 4 is a sectional view representing an injection profile expected with a subsequent position of a diverter in accordance with the method of the present invention.

FIG. 3 and FIG. 4 illustrate the scheme of the present invention with apparatus positioned in a subsurface viscous petroleum or tar sand formation 14. These figures illustrate only the horizontal portion 18 of the tubular member 16 and the packer 32 in its placement and inflation position within the hollow member 30 as shown in FIG. 1. FIG. 3 illustrates the packer 32 adjacent to the casing 22 of production well 12 at perforations 23. FIG. 4 illustrates the packer positioned laterally along and adjacent to other perforations 50 in the tubular member 18.

FIG. 3 and FIG. 4 illustrate idealized paths for injected hot fluids through the perforations 50 in the tubular member 18, into the formation 14 and along the exterior of the tubular member 18 into the production well 12 through perforations 23 in the casing 22. Initially the tubular member 18 may be a conduit for hot fluids between the injection well 10 and the production well 12 to heat the viscous petroleum adjacent to the exterior of the tubular member and radially out into the formation. When the formation has been sufficiently heated to make the viscous petroleum mobile, the packer 12 may be placed in the tubular member 18 to deflect the hot fluid out into the formation to function as a pusher fluid to move the viscous crude into the production well through perforations 23 in the casing 22. The tubular member 18 may have been installed with perforations 50 or the perforations may be added after the formation has been heated. In either case, the hot fluid now passes out into the formation through perforations 50 to move the heated viscous petroleum along the formation.

As shown in FIG. 1, the produced fluids are brought to the earth's surface by use of a pump 54 or other conventional means, where the fluid is monitored for content of petroleum and pusher fluid. When the ratio of these two fluids indicates that excessive pusher fluid is being produced, indicating a probable breakthrough of the hot fluid along the exterior of the tubular member, the packer 32 is then moved from its position to another location along the tubular member 18. The move will probably be toward the injection well and away from the production well because of the initial position of the packer 32 closest to the production well 12. In the new position some of the perforations 50 will be closed to injection, others will be preferred for injection, and others that previously functioned as injector perforations may now function as producer perforations to provide a path for produced petroleum and drive fluid through the tubular member 18. While production of produced petroleum through the perforations 50 in the horizontal portion 18 may carry some sand with it from a tar sand formation, that sand production will be inadequate to cause a sanding problem in the tubular member.

By monitoring the ratio of produced petroleum and pusher fluid and controlling the position of the packer 32 within the tubular member 18 accordingly, it is possible to maximize the production of petroleum and minimize the production of pusher fluid.

Several variations in packer placement and control are contemplated. One variation is to place the packer initially closer to the injector well and allow the hot fluids to pass around the packer and along the tubular member to heat the formation. As the entire formation adjacent to the tubular member comes up to the temperature where the viscous petroleum becomes mobile, the packer may be moved toward the producer and the drive fluid is passed out through the perforations to move the viscous petroleum. Another alternative is to provide a series of packers laterally along the horizontal portion of the tubular member. The control mechanism then could control the inflation and deflation of the several packers to control heating of the formation and injection of the drive fluid.

A further alternative to this technique of diversion control is to plug, in a step-wise manner, the horizontal perforated tubular member. Several feet of the tubular member, farthest from the injection end, would be cemented off subsequent to or immediately prior to drive fluid breakthrough thus insuring that the drive fluid would pass out through the clear perforations to move the viscous crude toward the production well.

While the invention disclosed herein has been described, as operating in a tar sand petroleum-containing formation, it should be understood that the invention is not limited only to applications in tar sands. The method described would work equally as well in other formations, such as carbonate or bituminous sand deposits, for instance the Grosmont Carbonate Reef in Canada or in the bituminous sand formations in the United States, where conventional drive processes are ineffective because of virtually zero effective permeability of the formation.

While certain preferred embodiments of the invention have been specifically disclosed, it should be understood that the invention is not limited thereto as many variations will be readily apparent to those skilled in the art and the invention is to be given its broadest possible interpretation within the terms of the following claims.

What is claimed is:

1. A method of assisting the recovery of viscous petroleum from a petroleum-containing formation comprising:

(a) forming a generally horizontal hole through a petroleum-containing formation;

(b) inserting a solid-wall, hollow tubular member into said generally horizontal hole to provide a continuous flow path through said formation;

(c) perforating said tubular member;

(d) flowing a hot fluid through the interior of said tubular member to heat viscous petroleum in said formation outside said tubular member to reduce the viscosity of at least a portion of the petroleum adjacent the outside of said tubular member to provide a potential passage for fluid flow through said formation adjacent the outside of said tubular member;

(e) positioning a movable diverter within said tubular member;

(f) injecting a drive fluid into said formation through said perforations and into said passage adjacent the outside of said tubular member to promote movement of the petroleum through said passage adjacent the outside of said tubular member to a recovery position for recovery from said formation;

(g) monitoring the production of petroleum and drive fluid at said recovery position;

(h) and positioning said diverter within said tubular member to selectively control the injection of drive fluid through said perforations to maintain said passage adjacent the outside of said tubular member and promote movement of said petroleum.

2. The method of claim 1, wherein a substantially vertical injection well and a substantially vertical production well is drilled into said petroleum-containing formation and said generally horizontal hole is formed between and connecting said injection well and said production well.

3. The method of claim 2 wherein said diverter is a settable, inflatable packer.

4. The method of claim 3 wherein said diverter is positioned with a means passing into said tubular member in said generally horizontal hole from at least one of said injection well and said production well.

5. The method of claim 4 wherein said diverter is initially positioned adjacent to said production well and moved toward said injection well through said tubular member in accordance with said monitored ratio of said hot fluid and petroleum at said recovery position.

6. The method of claim 4 wherein the effective position of said diverter within said tubular member is controlled in a series of positions away from and toward said production well to maintain hot fluid flow into said formation along said tubular member to maintain heating and movement of said heated, reduced viscosity petroleum to said recovery position, said movement of said diverter being in accordance with monitored ratio of said hot fluid and petroleum.

7. The method of claim 5 wherein said diverter is inflatable and deflatable and said inflation and deflation is controlled in accordance with the positioning of said diverter within said casing.

8. The method of claim 1 wherein said hot fluid and said drive fluid are steam and wherein the condition of at least said drive fluid steam is controlled in accordance with said monitored production of said petroleum and drive fluid at said recovery position.

9. The method of claim 1 wherein said perforations in said tubular member on one side of said diverter function as flow paths for said hot fluid and drive fluid into said formation and on the other side of said diverter as flow paths for petroleum, hot fluid and drive fluid toward said recovery position depending upon the position of said diverter within said tubular member.

* * * * *